US005085523A

United States Patent [19]

Hobbs

[11] Patent Number: 5,085,523

[45] **Date of Patent: * Feb. 4, 1992**

[54] SLIDE RELEASE MECHANISM

[75] Inventor: James D. Hobbs, Plainfield, Ind.

[73] Assignee: General Devices Co., Inc., Indianapolis, Ind.

[ * ] Notice: The portion of the term of this patent subsequent to Feb. 19, 2008 has been disclaimed.

[21] Appl. No.: 570,880

[22] Filed: Aug. 22, 1990

Related U.S. Application Data

[63] Continuation-in-part of Ser. No. 389,958, Aug. 7, 1989, Pat. No. 4,993,847.

[51] Int. Cl.[5] ..... F16C 29/04; A47B 88/00

[52] U.S. Cl. ..... 384/21; 384/18; 312/348

[58] Field of Search ..... 384/18–21; 312/348, 333

[56] References Cited

U.S. PATENT DOCUMENTS

| | | | |
|---|---|---|---|
| 3,462,203 | 8/1969 | Del Vecchio . | |
| 3,650,578 | 3/1972 | Del Vecchio et al. | 384/18 |
| 4,200,342 | 4/1980 | Fall | 312/348 X |
| 4,423,914 | 1/1984 | Vander Ley | 384/90 X |
| 4,549,773 | 10/1985 | Papp et al. | 384/21 X |
| 4,610,487 | 9/1986 | Delmege et al. | 384/18 |
| 4,696,582 | 9/1987 | Kasten | 384/18 |
| 4,993,847 | 2/1991 | Hobbs | 384/21 |

*Primary Examiner*—Thomas R. Hannon
*Attorney, Agent, or Firm*—Barnes & Thornburg

[57] ABSTRACT

A slide track assembly is provided for supporting movable drawers or the like in a cabinet. The slide track assembly includes a first slide track and a second slide track coupled to the first slide track for sliding movement thereon. A locking pin is mounted on the second slide track to project into the aperture formed in a flexible strip mounted on the first slide track upon alignment of the first and second slide tracks in a predetermined position. A button on the second slide track is movable against the flexible strip to urge the flexible strip out of locking engagement with the locking pin, thereby permitting relative movement of the first and second slide tracks.

17 Claims, 3 Drawing Sheets

SLIDE RELEASE MECHANISM

This is a continuation-in-part of the co-pending patent application "Slide Release Mechanism", U.S. Ser. No. 07/389,958, filed Aug. 7, 1989 U.S. Pat. No. 4,993,847.

FIELD OF THE INVENTION

This invention relates to drawer slide locking hardware and particularly to an improved mechanism for manually releasing a lock that functions to prevent relative longitudinal movement of two sliding tracks.

BACKGROUND AND SUMMARY OF THE INVENTION

Convenient access to articles contained in cabinets, chests, or other storage devices can be encouraged by constructing movable drawers or shelving that can be easily extended outward from the body of the storage device when access is desired, and returned into the body of the storage device after the desired article is retrieved. A commonly employed mechanism for enabling the relative movement of a drawer and a storage device is a sliding track, such as described in U.S. Pat. No. 3,950,040 to Fall, or U.S. Pat. No. 4,089,568 to Fall et al., both herein incorporated by reference.

A useful feature for a sliding track is a mechanism that can stop the sliding track from moving once a predetermined extended position is reached. A mechanism of this sort allows a movable drawer or shelf to be extended and locked in that desired position until the mechanism is released. The use of a locking mechanism to prevent relative movement of two sliding tracks until manual release of the locking mechanism is known in the prior art. See, for example , U.S. Pat. No. 4,200,342 to Fall et al.

It is therefore an object of this invention to provide a lock mechanism that prevents the relative movement of a first sliding track and a second sliding track.

Yet another object of this invention is to provide a release mechanism for a lock mechanism that prevents the relative movement of a first sliding track and a second sliding track.

It is also an object of the invention to provide a release mechanism that is operable in response to the insertion of a finger into an aperture situated in a sliding track for effecting release of the locking mechanism.

A further object of this invention is to provide a release mechanism for a lock mechanism of a sliding track that is operated by a finger inserted into an aperture situated in a sliding track and that is configured to provide the operator with a characteristic feel and positive response indicating successful release of the lock mechanism.

In accordance with the present invention a slide track assembly includes a first slide track, a second slide track, and means for coupling the first slide track to the second slide track for sliding movement. The slide track assembly also includes means for blocking relative movement between the first and second slide tracks to establish a locked connection therebetween and means on one of the first and second slide tracks for selectively unlocking the blocking means to break the locked connection between the first and second slide tracks to permit relative movement therebetween.

In preferred embodiments, the first slide track is attached to a drawer and coupled in sliding engagement to the second slide track by means that include a plurality of ball bearings. The second slide track is also slidably connected to a third slide track that is typically attached to a cabinet.

The blocking means illustratively includes a locking pin and a flexible strip having an aperture for receiving the locking pin. The locking pin is mounted on the second slide track and the flexible strip is mounted on the the first slide track. The flexible strip is made of spring material and has one end fixed to the first slide track and another end that is movable relative to the first slide track.

The unlocking means includes means on the second slide track for urging a portion of the flexible strip toward the first slide track to release the locking pin from engagement in the aperture formed in the flexible strip so that relative movement of the first and second slide tracks is permitted.

In one embodiment the second slide track is formed to include an aperture. A button is supported by the second slide track for movement through the aperture to contact the flexible strip of the blocking means and urge a portion of the flexible strip toward the first slide track to release the locking pin from engagement in the aperture formed in the flexible strip so that relative movement of the first and second slide tracks is permitted. In an alternative embodiment, a plate having a first end and a second end is attached at its first end to the second slide track. The plate is situated to have a depressible portion accessible through the aperture in the second slide track. Depressing the depressible portion acts to encourage the second end of the plate to urge a portion of the flexible strip toward the first slide track to release the locking pin from engagement in the aperture formed in the flexible strip so that relative movement of the first and second slide tracks is permitted.

An advantageous feature of the invention follows from the separate mounting of the flexible strip on the first slide track and the button on the second slide track. This arrangement permits an operator to break the locked connection by urging the button into contact with the flexible strip.

Another advantageous feature of this invention is the use of a flexible strip formed to include a pin-receiving aperture. The flexible strip can yieldably engage the locking pin upon relative movement of the first and second slide tracks toward a predetermined position, and rebound to trap the locking pin in the pin-receiving aperture upon reaching the predetermined position. The flexible spring is both easy to produce and attach to the required position on the first slide track, and effectively acts to block relative movement until manually released by depressing the release button.

In those embodiments having an unlocking means that includes a button, an advantageous feature is derived from the interaction of the button, the flexible strip, the second slide track, and a radial lip on the button. These elements cooperate to provide a tactile signal that indicates the release of the locking pin. The button is supported by the second slide track so that urging movement is hindered by contact of the radial lip on the button and the second slide track, which prevents depression of the flexible strip further than is necessary to effect disengagement of the locking pin from the aperture for receiving the locking pin situated on the flexible strip. When the operator pressing the button encounters resistance to further depression, the operator can be assured by this tactile signal that the blocking means has been rendered inoperative, and movement of the first slide track relative to the second slide track is enabled.

Additional objects, features, and advantages of the invention will become apparent to those skilled in the art on consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
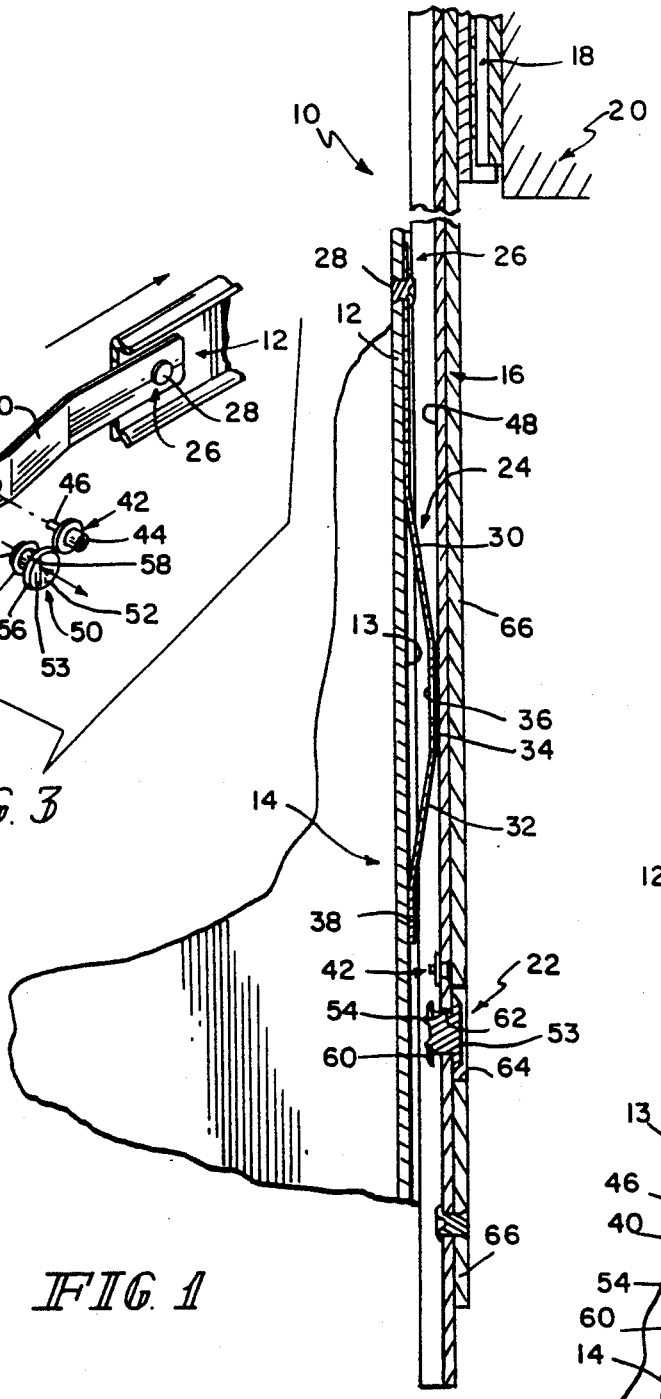
FIG. 1 is a sectional view of a lock and release mechanism for a slide track assembly in accordance with the present invention showing a pair of connected drawer slides in an extended position away from a cabinet and unlocked for movement relative to one another.
Figure 2:
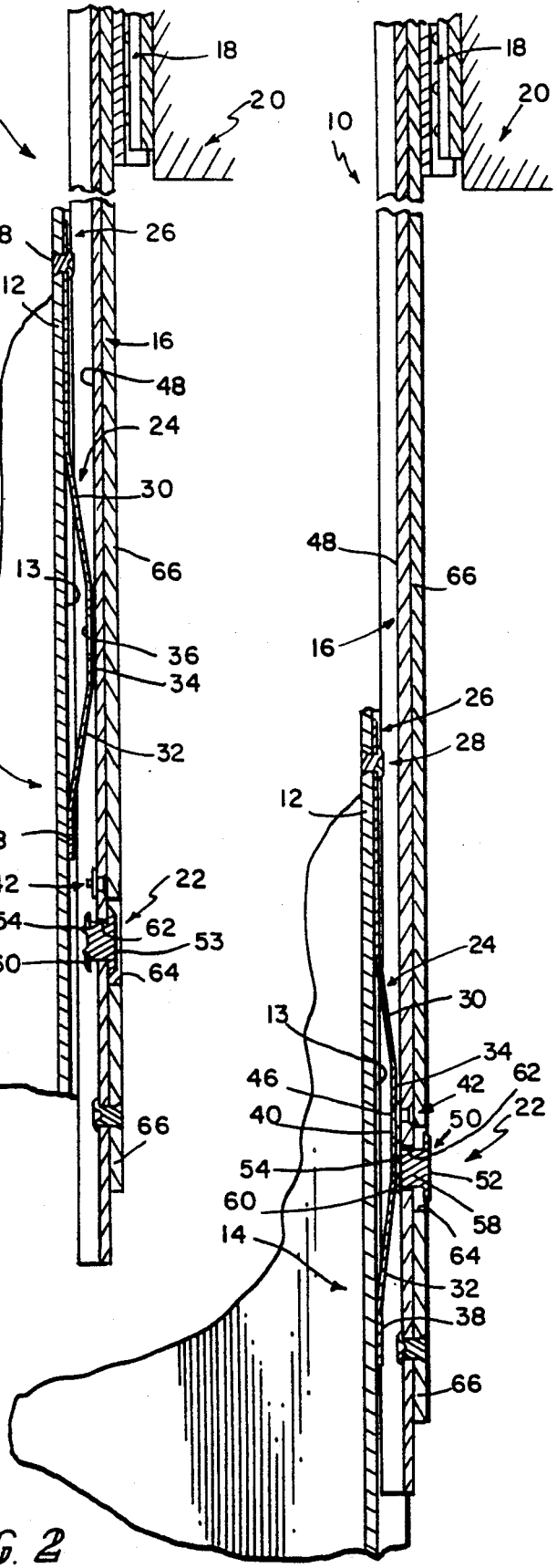
FIG. 2 is a sectional view of the sliding tracks connected to a drawer and a cabinet, following actuation of a locking element to lock one of the extended slide tracks relative to the other to prevent relative movement therebetween.

As illustrated in FIGS. 1 and 2, the present invention is a drawer slide mechanism assembly 10 that includes a first slide track 12 for stationary attachment to a drawer 14, a second slide track 16, and a third slide track 18 for stationary attachment to a cabinet 20 or the like.

The drawer 14, partially shown in FIGS. 1 and 2 for the purpose of clarity, can movably extend outward from the cabinet 20 and is suitable for the storage of desired articles (not shown). A movable shelf, platform, chassis or other movable device for storing desired articles could also be attached to the first slide track 12.

The first, second, and third slide tracks 12, 16, 18 are slidably connected to one another to provide a telescoping slide assembly. This arrangement advantageously permits an increased, telescoping extension of the drawer 14 away from the cabinet 20 to allow easy access to the drawer 14.

The sliding movement of the first slide track 12 and its attached drawer 14 relative to the second slide track 16 can be arrested by a lock and release mechanism 22. Mechanism 22 is also shown in an exploded perspective view in FIG. 3. As best shown in FIG. 2, upon alignment of the first and second slide tracks 12 and 16 in a predetermined position a locked connection is established therebetween, blocking any further relative movement of first and second slide tracks.

As shown FIGS. 1 and 2, the lock and release mechanism 22 has a flexible strip 24 having an attachment end 26 attached to an inner wall 13 of the first slide track 12 by means of an attachment bolt 28. The flexible strip 24 is configured to extend away from the first slide track 12 toward the second slide track 16. The flexible strip 24 is bent to provide in series the attachment end 26, a first ramp 30, a raised land 34, a second ramp 32, and a second end 38. The first ramp 30 is integral with the attachment end 26 and oriented to extend toward the second slide track 16. The raised land 34 is oriented to lie in substantially spaced-apart parallel relation to both the first and second slide tracks 12 and 16. The sliding section 38 is maintained in slidable contact with the first slide track 12.

Locking the first slide track 12 in relation to the second slide track 16 is enabled by the cooperation of a pin-receiving aperture 40 formed in the raised land 34 of the flexible strip 24 and a locking pin 42 permanently mounted on second slide track 16. The locking pin 42 has a first end 44 which is fixed onto an inner member 48 of the second slide track 16, and a second end 46 that extends toward the first slide track 12. The second end 46 projects toward the first slide track 12 an amount sufficient to enable entrance into the locking pin aperture 40.

In operation, movement of the first and second slide tracks 12 and 16 toward a predetermined position causes the flexible strip 24 to be yieldably engaged by the second end 46 of the locking pin 42. Further movement of the slide tracks 12 and 16 toward the predetermined position causes the locking pin 42 to depress the flexible strip 24 toward the first slide track 12 until the pin-receiving aperture 40 is encountered by the second end 46 of the locking pin 42. The flexible strip 24 rebounds toward the second slide track 16, trapping the second end 46 of the locking pin 42 in the locking pin aperture 40. Once the second end 46 of the locking pin 42 is situated in the locking pin aperture 40, further sliding movement of the first slide track 12 relative to the second slide track 16 is blocked, effectively locking the position of drawer 14 in an extended position, as is illustrated in FIG. 2.

Figure 3:
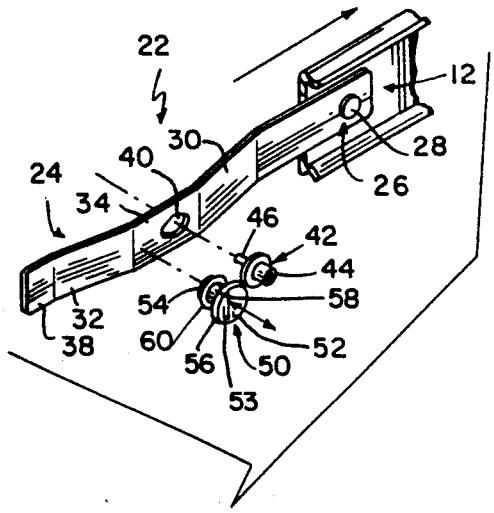
FIG. 3 is an exploded perspective view of the lock and release mechanism of FIGS. 1 and 2.
Figure 4:
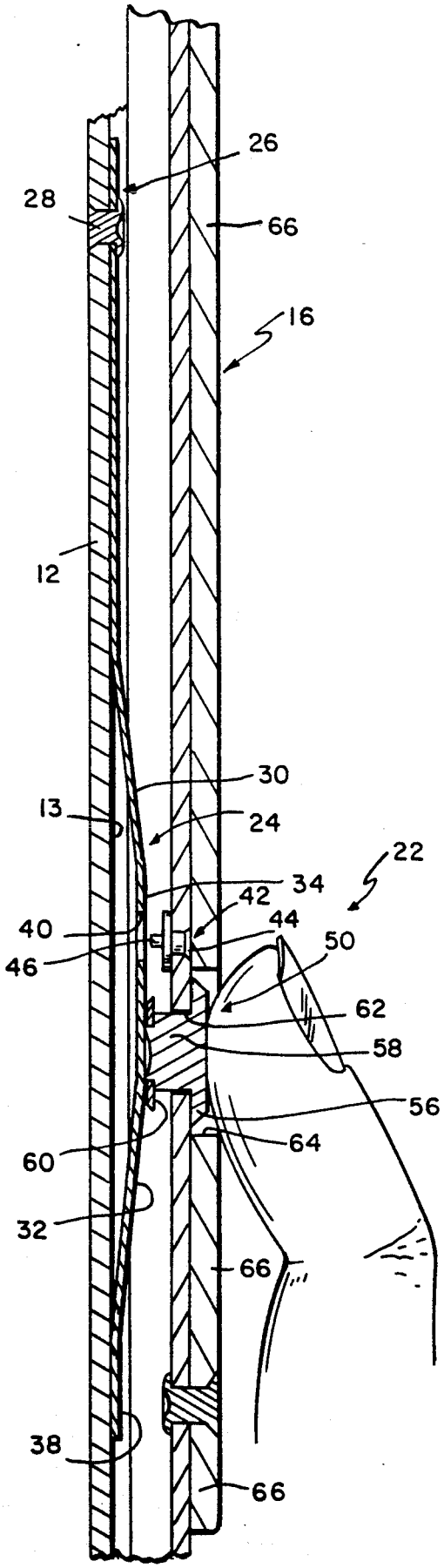
FIG. 4 is a sectional view of the embodiment shown in FIGS. 1 and 2 illustrating the release of the locking element in response to manual depression of a button.

As shown in FIG. 4, release of the mechanism 22 is effectuated by manually pressing a surface 53 of a first end 52 of a button 50 with a force directed toward the first slide track 12 and substantially perpendicular to the surface 53 of the button 50. As best illustrated in FIGS. 3 and 4, the button 50 is held in the proper position on the second slide track 16 by the cooperation of a first radial lip 56, a stem 58, and a second radial lip 60. The first radial lip 56 is located at a second end 52 of the button 50, and the second radial lip 60 is located at the first end 54 of the button 50. The first radial lip 56 is separated from the second radial lip 60 by the stem 58, which is formed having a radial diameter less than either the first radial lip 56 or the second radial lip 60. The stem 58 extends through an inner member aperture 62 situated in the inner member 48 of the second slide track 16. The inner member aperture 62 has a radial diameter exceeding the radial diameter of the stem 58, but has a radial diameter less than the radial diameter of either the first radial lip 56 or the second radial lip 60. This configuration permits the button 50 to move freely toward or away from the first slide track 12 for a distance corresponding to the length of stem 58 between the first radial lip 56 and the second radial lip 60.

To aid in identifying the surface 53 of the button 50, the surface 53 can be provided with coded indicia, either tactile or visual, that aid the operator in identifying the surface 53. For example, the surface 53 can be provided with raised patterns, engraved with grooves, cross-hatched, or fitted with any other surface pattern that provides tactile indication of the surface 53 of the button 50. The visual identification of the surface 53 of the button 50 can be facilitated by marking the surface 53 of the button 50 with selected colors (for example, green, blue, or other primary colors), labels, symbols, icons, or other markings that distinguish the surface 53 of the button 50.

As best shown in FIG. 4, the second radial lip 60 is situated in an outer member aperture 64 set in an outer member 66 of the second slide track 16. The outer member aperture 64 has a diameter greater than the second radial lip 60. In the embodiment shown in FIGS. 1–4, the outer member aperture 64 has a diameter substantially greater than a diameter of a human fingertip, enabling a person to easily press the first end 52 of the button 50.

Additionally, in this embodiment, the distance between the first radial lip 56 and the second radial lip 60, in combination with longitudinal thickness of the first end 52 of the button 50 is substantially equal to or less than the thickness of the outer member 66 of the second slide track 16. By this configuration, first end 52 of the button 50 is recessed or only slightly protrudes from the second slide track 16.

The button 50 is situated adjacent to the locking pin 42 on the second slide track 16. As best illustrated in FIG. 4, pressing the button 50 toward the first slide track 12 when the first slide track 12 and the second slide track 16 are in the predetermined locking position brings the raised land 34 of the flexible strip 24 and the second end 54 of the button 50 into contact. The raised land 34 of the flexible strip 24 is depressed by urging the button 50 toward the first slide track 12 through a distance greater than the extension of the second end 46 of the locking pin 42 into the pin-receiving aperture 40. This breaks the locked connection between the first and second slide tracks, permitting the drawer 14 to be slidably moved as desired.

The flexible strip 24 is preferably constructed of a resilient material such as steel or engineering grade plastic that is capable of tolerating repeated flexure. The flexible strip 24 is configured to withstand repeated forces exerted thereon by button 50. This force is directed against either the first ramp 30, the second ramp 32, or the land 34. Any force so directed can cause the second end 38 to slide along the first slide track 12. When the force is relieved, the flexible strip 24 returns to its former position by a spring action dependent on the material of which the flexible strip 24 is constructed.

Figure 5:
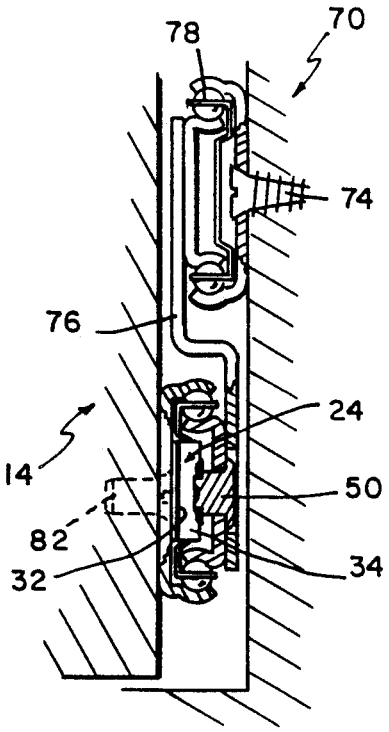
FIG. 5 is a view of another embodiment of the present invention showing an over-and-under track assembly.

Another embodiment of the invention is illustrated in FIG. 5. The present invention is not limited to sliding track assemblies having slide tracks coaxially arranged such as shown in FIG. 2–3, but can be used, for example, in an over-and-under track assembly 70 such as illustrated in FIG. 5. An upper track 72 is attached in part to a cabinet 20 by an upper track attachment screw 74. The upper track 72 lies in sliding relationship with a central track 76. Sliding support of the central track 76 is provided by a plurality of ball bearings 78 situated in rolling relationship between the central track 76 and the upper track 72.

The central track 76 extends downwardly to engage in sliding relationship with a lower track 80, also supported by ball bearings 78 situated in rolling relationship between the central track 76 and the lower track 80. The lower track 80 is attached to a drawer 14 by a lower track attachment bolt 82. The lock and release mechanism 22 according to the present invention is situated to act between the central track 76 and the lower track 80, preventing extension of the lower track 80 relative to the central track 76 without manual release of the lock and release mechanism 22 by depression of a button 50. The button 50 is used to depress the flexible strip 24 to release its locking engagement with locking pin 42 (not shown in FIG. 5)

Figure 6:
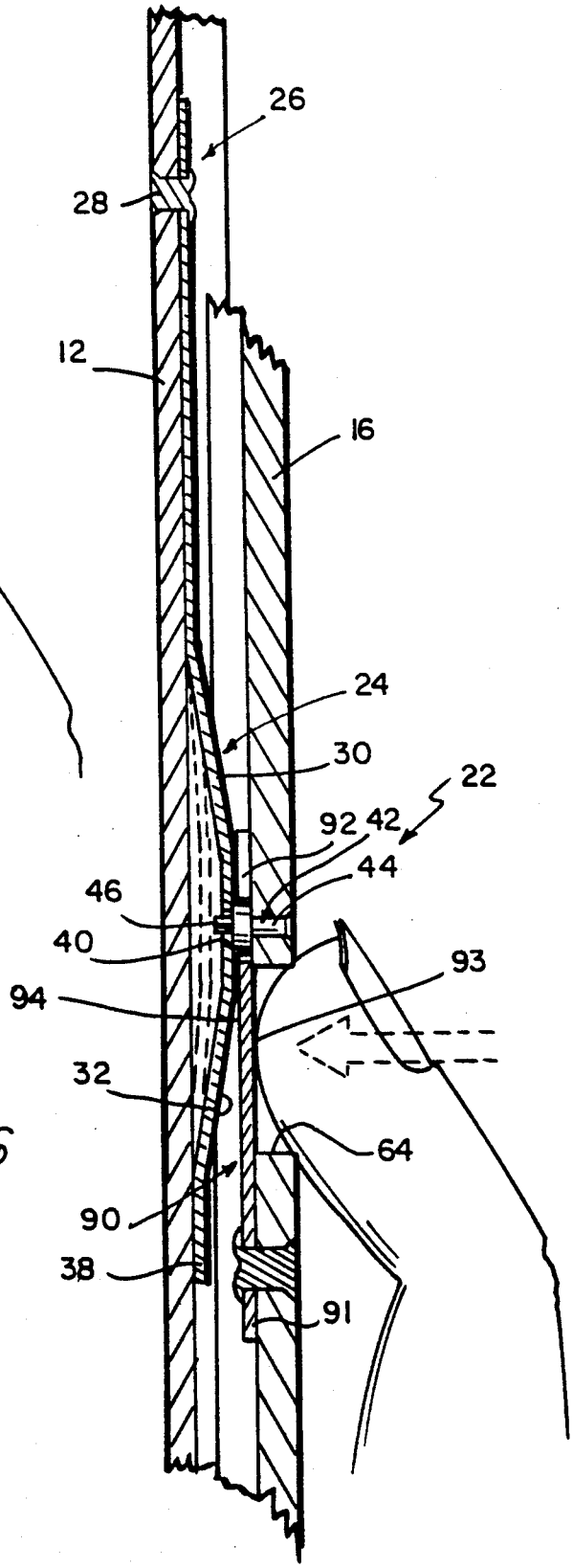
FIG. 6 is a sectional view of another embodiment of the present invention illustrating the release of the locking element in response to manual depression of a plate.

Another embodiment of the invention is illustrated in FIG. 6. A plate 90 having a first end 91 and a second end 92 is attached at its first end 91 to the second slide track 16. The plate 90 forms a cantilever, with the second end 92 being movable in response to force applied to a depressible surface 93 and directed toward the first slide track 12. Application of force against the depressible surface 93 of the plate 90 in this direction acts to depress the second end 92 of the plate 90 toward the first slide track 12, simultaneously encouraging an inner surface 94 of the plate 90 to contact the raised land 34 of the flexible strip 24. Continued application of force causes the raised land 34 of the flexible strip 24 to be depressed towards the first slide track 12 until a distance greater than the extension of the second end 46 of the locking pin 42 into the pin-receiving aperture 40 achieved, breaking the locked connection between the first and second slide tracks 12 and 16.

Figure 7:
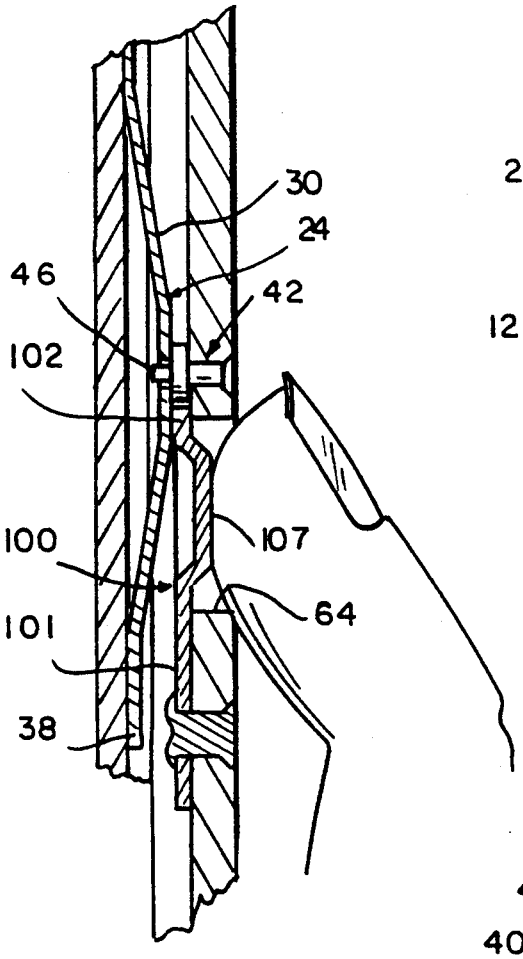
FIG. 7 is a sectional view of an embodiment of the present invention illustrating a plate having a raised surface that provides tactile indication of the plate.

In operation, release of the locked connection between the first slide track 12 and the second slide track 16 is provided by the action of a finger of an operator who forceably depresses the plate 90 toward the first slide track 12 by exerting force substantially perpendicular to the depressible surface 93. To aid in identifying the depressible surface 93, it can be provided with coded indicia, either tactile or visual, that aid the operator in identifying the depressible surface 93. For example, the depressible surface 93 can be provided with raised patterns, engraved with grooves, cross-hatched, or fitted with any other surface pattern that provides tactile indication of the depressible surface 93. An example of a tactile indicator is illustrated in FIG. 7, in which a plate 100 having a first end 101 and a second end 102 is formed to have a raised surface 107 that protrudes into the aperture 64, providing a tactile indication that identifies the plate 100. The visual identification of the depressible surface 93 or the raised surface 107 can be facilitated by marking the depressible surface 93 or raised surface 107 with selected colors (for example, green, blue, or other primary colors), labels, symbols, icons, or other markings that distinguish the depressible surface 93 and the raised surface 107.

Although the invention has been described in detail with reference to certain preferred embodiments, variations and modifications exist within the scope and spirit of the invention as described and defined in the following claims.

What is claimed is:

1. A slide track assembly comprising first and second slide tracks, means for coupling the second slide track to the first slide track for sliding movement thereon, means for blocking relative movement of the first and second slide tracks to establish a locked connection therebetween, the blocking means including a locking pin mounted on the second slide track and spring means mounted on the first slide track for yieldably engaging the second slide track upon alignment of the first and second slide tracks in a predetermined position, the spring means including a flexible strip formed to include an aperture situated to receive the locking pin therein upon movement of the first and second slide tracks to said predetermined position, and means attached to the second slide track for selectively unlocking the blocking means to break the locked connection between the first and second slide tracks to permit relative movement therebetween.

2. The assembly of claim 1, wherein the unlocking means includes means on the second slide track for urging the flexible strip toward the first slide track to release the locking pin from engagement in the aperture formed in the flexible strip to permit relative movement of the first and second slide tracks.

3. The assembly of claim 2, wherein the first slide track includes an inner wall facing the second slide track, and the flexible strip includes a first end mounted on the inner wall and a raised land.

4. The assembly of claim 3, wherein the unlocking means includes means on the second slide track for urging the raised land toward the first slide track to release the locking pin from engagement in the aperture to permit relative movement of the first and second slide tracks.

5. The assembly of claim 1, wherein the first slide track is attached to a drawer and further including a third slide track coupled to the second slide track for sliding movement thereon.

6. The assembly of claim 5, wherein the first slide track, the second slide track, and the third slide track are aligned in a substantially parallel orientation.

7. A slide track assembly comprising first and second slide tracks, the second slide track being formed to include an aperture, means for coupling the second slide track to the first slide track for sliding movement thereon, means for blocking relative movement of the first and second slide tracks to establish a locked connection therebetween, and means on one of the first and second slide tracks for selectively unlocking the blocking means to break the locked connection between the first and second slide tracks to permit relative movement therebetween, and the unlocking means including a plate attached to the second slide track and accessible through the aperture to be depressed to engage the blocking means.

8. The assembly of claim 7, wherein the blocking means includes a flexible strip yieldingly engaging the second slide track upon alignment of the first and second slide tracks in a predetermined position, and the plate is movable to urge the flexible strip to a position disengaging the second slide track so that the first slide track is movable relative to the second slide track.

9. The assembly of claim 8, wherein the blocking means further includes a locking pin mounted on the second slide track, the flexible strip is formed to include an aperture situated to receive the locking pin therein upon movement of the first and second slide track to said predetermined position, and the flexible strip is moved away from the second slide track to release the locking pin from engagement in the aperture formed in the flexible strip in response to movement of the plate away from the second slide track and toward the first slide track.

10. A slide track assembly comprising first and second slide tracks, means for coupling the second slide track to the first slide track for sliding movement thereon, a flexible strip mounted on the first slide track, a locking pin mounted on the second slide track to engage the flexible strip to establish a locked connection between the first and second slide tracks when the first and second slide tracks are in a predetermined position, and a plate attached to the second slide track, said plate being movable relative to the second slide track to break the locked connection between the first and second slide tracks to permit relative movement therebetween.

11. The assembly of claim 10, wherein the first slide track is attached to a drawer and further including a third slide track coupled to the second slide track for sliding movement thereon.

12. The assembly of claim 11, wherein the first slide track, the second slide track, and the third slide track are aligned in a substantially parallel orientation.

13. The assembly of claim 12, wherein the flexible strip includes a first end coupled to the first slide track, a second end slidably engaging the first slide track, a raised land between the first and second ends, and the raised land is formed to include a locking pin-receiving aperture to engage the locking pin in locking connection upon movement of the first and second slide tracks to said predetermined position.

14. The assembly of claim 13, wherein the second slide track is formed to include an aperture, and wherein said plate is accessible through the aperture.

15. The assembly of claim 14, wherein the flexible strip is formed to include an aperture situated to receive the locking pin therein upon movement of the first and second slide track to said predetermined position, and wherein the flexible strip is moved away from the second slide track to release the locking pin from engagement in the aperture formed in the flexible strip in response to movement of the plate away from the second side track and toward the first slide track.

16. A slide track assembly comprising first and second slide tracks, means for coupling the second slide track to the first slide track for sliding movement thereon, means for blocking relative movement of the first and second slide tracks to establish a locked connection therebetween, the blocking means including a first movable member mounted on the first slide track, and means for selectively unlocking the blocking means to break the locked connection between the first and second slide tracks to permit relative movement therebetween, the unlocking means including a second movable member attached to the second slide track, wherein the second movable member is provided with coded indicia that facilitates the identification of said second movable member.

17. The assembly of claim 16, wherein the coded indicia for facilitating the identification of the second movable member is at least one selected color.

* * * * *